US010651579B2

(12) United States Patent
Ono

(10) Patent No.: US 10,651,579 B2
(45) **Date of Patent: *May 12, 2020**

(54) CONNECTOR

(71) Applicant: Molex, LLC, Lisle, IL (US)

(72) Inventor: Hiroki Ono, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/276,655

(22) Filed: Feb. 15, 2019

(65) Prior Publication Data

US 2019/0181572 A1 Jun. 13, 2019

Related U.S. Application Data

(63) Continuation of application No. 15/972,328, filed on May 7, 2018, now Pat. No. 10,249,969.

(30) Foreign Application Priority Data

May 10, 2017 (JP) ..... 2017-093756

(51) Int. Cl.
*H01R 12/00* (2006.01)
*H01R 12/71* (2011.01)
(Continued)

(52) U.S. Cl.
CPC ..... *H01R 12/716* (2013.01); *H01R 12/7011* (2013.01); *H01R 13/504* (2013.01); *H01R 13/631* (2013.01); *H01R 12/73* (2013.01)

(58) Field of Classification Search
CPC ..... H01R 12/716; H01R 12/7011; H01R 13/504; H01R 13/631; H01R 12/73
(Continued)

(56) References Cited

U.S. PATENT DOCUMENTS 7,172,434 B2 * 2/2007 Obikane ..... H01R 24/60 439/570
9,362,637 B2 * 6/2016 Hasegawa ..... H01R 12/716
(Continued)

FOREIGN PATENT DOCUMENTS

CN 104241951 A 12/2014
JP 2010-198996 A 9/2010
(Continued)

OTHER PUBLICATIONS

Notice of Allowance received for Korean application No. 10-2018-0053047, dated May 15, 2019, 2 pages. (1 page of English Translation and 1 pages of Official copy).

*Primary Examiner* — Khiem M Nguyen
(74) *Attorney, Agent, or Firm* — Molex, LLC

(57) ABSTRACT

High reliability is achieved with a protected state guaranteed for housings with reinforcing brackets being rigid to be free from displacement and misorientation. A connector includes: a connector body; a terminal installed in the connector body; and a reinforcing bracket fit to the connector body. The connector body includes a recess in which a mating connector body of a mating connector fits, and an insular part that is in the recess and fits in a groove part of the mating connector body. The reinforcing bracket includes an inner reinforcing bracket fit to an insular end part that is an end portion of the insular part in a longitudinal direction. The inner reinforcing bracket includes a body part that is disposed on an upper surface of the insular end part, an end plate that is connected to the body part and is disposed on an end surface of the insular end part, a pair of side plates that are connected to right and left ends of the body part and are disposed on right and left side surfaces of the insular end part, and a pair of connecting legs that are each connected to a lower end of a corresponding one of the side plates and
(Continued)

extend outward in a right and left direction of the connector body.

5 Claims, 7 Drawing Sheets

(51) Int. Cl.
*H01R 13/504* (2006.01)
*H01R 13/631* (2006.01)
*H01R 12/70* (2011.01)
*H01R 12/73* (2011.01)

(58) Field of Classification Search
USPC ..... 439/65, 66, 74
See application file for complete search history.

(56) References Cited

U.S. PATENT DOCUMENTS

| | | | | |
|---|---|---|---|---|
| 9,590,327 | B2 * | 3/2017 | Matsuno | H01R 12/7005 |
| 9,899,771 | B2 * | 2/2018 | Ashibu | H01R 12/716 |
| 9,997,852 | B2 * | 6/2018 | Chen | H01R 12/7017 |
| 10,249,969 | B2 | 4/2019 | Ono | |

FOREIGN PATENT DOCUMENTS

| | | | |
|---|---|---|---|
| JP | 2016-085994 | A | 5/2016 |
| KR | 2015-0110313 | A | 10/2015 |

* cited by examiner

CONNECTOR

RELATED APPLICATIONS

This application is a continuation of U.S. patent application Ser. No. 15/972,328, filed May 7, 2018, which issued as U.S. Pat. No. 10,249,969 on Apr. 2, 2019, which claimed priority to Japanese Application No. 2017-093756, filed May 10, 2017. Each of the foregoing applications are incorporated herein by reference in their entireties.

TECHNICAL FIELD

The present disclosure relates to a connector.

BACKGROUND ART

Conventionally, connectors such as board to board connectors, etc., have been used to electrically connect pairs of parallel circuit boards together. Such connectors are attached to mutually facing surface of a pair of circuit boards and are mated together so that electrical conduction is established. In this context, a technique of maintaining a state of being mated with a mating connector, with reinforcing brackets attached to both end portions serving as lock members, has been proposed (see, for example, Patent Document 1).

FIG. 7 is a perspective view illustrating a conventional connector.

In the figure, 811 is a first housing that is a housing for a first connector mounted on a first circuit board not illustrated, and 911 is a second housing that is a housing for a second connector mounted on a second circuit board not illustrated. The first circuit board and the second circuit board are electrically connected to each other with the first connector and the second connector mated. In the figure, the first housing 811 has a mating surface facing upward and the second housing 911 has a mating surface facing downward. With this arrangement, the first connector is relatively moved toward the second connector, whereby the connectors can be mated.

The first housing 811 includes a recess 812 that receives the second housing 911 and a protrusion 813 formed at the center of the recess 812. The first housing 811 is provided with a plurality of first terminals 861, and has outer reinforcing brackets 851 attached to both ends in a longitudinal direction and inner reinforcing brackets 871 attached to both ends of the protrusion 813 in the longitudinal direction.

The second housing 911 is provided with a plurality of second terminals 961, and has reinforcing brackets 951 attached to both ends in the longitudinal direction.

When the first connector and the second connector are mated, the first terminals 861 and the respective second terminals 961 come into contact with each other. As a result, the first circuit board and the second circuit board are electrically connected to each other. The second housing 911 is inserted in the recess 812 of the first housing 811, and the reinforcing brackets 951 engage with the outer reinforcing brackets 851. When the second housing 911 is inserted into the recess 812 of the first housing 811, the reinforcing brackets 951 might collide with both ends of the protrusion 813 in the longitudinal direction. Still, the inner reinforcing brackets 871 attached as described above prevent both ends of the protrusion 813 in the longitudinal direction from being damaged.

Patent Document 1: Japanese Unexamined Patent Application Publication No. 2016-031842

SUMMARY

However, the conventional connector has the inner reinforcing brackets 871 provided on only one of the side surfaces of a corresponding one of the end portions of the protrusion 813 in the longitudinal direction, and is not provided on the other side surface. Thus, when strong force in a diagonal direction is applied due to the collision of the reinforcing bracket 951, the inner reinforcing bracket 871 might be displaced from the attached position or may be misoriented. As a result, the end portion of the protrusion 813 in the longitudinal direction might be damaged.

An object herein is to solve the problem of the conventional connector, and to provide a connector with high reliability that includes rigid reinforcing brackets to be free from displacement and misorientation, and ensures a protected state of housings to be maintained.

To achieve this object, a connector includes: a connector body; a terminal installed in the connector body; and a reinforcing bracket fit to the connector body. The connector body includes a recess in which a mating connector body of a mating connector fits, and an insular part that is in the recess and fits in a groove part of the mating connector body. The reinforcing bracket includes an inner reinforcing bracket fit to an insular end part that is an end portion of the insular part in a longitudinal direction. The inner reinforcing bracket includes a body part that is disposed on an upper surface of the insular end part, an end plate that is connected to the body part and is disposed on an end surface of the insular end part, a pair of side plates that are connected to right and left ends of the body part and are disposed on right and left side surfaces of the insular end part, and a pair of connecting legs that are each connected to a lower end of a corresponding one of the side plates and extend outward in a width direction of the connector body.

In another connector, the connecting legs each have a distal end connected to a surface of a substrate on which the connector is mounted.

In yet another connector, the connecting legs each have a lower surface at least partially exposed on a lower surface of the connector body.

In still another connector, the inner reinforcing bracket is at least partially embedded in the connector body, and is integrated with the connector body.

In further another connector, the connector body includes mating guide parts that are formed on both ends of the connector body in the longitudinal direction and are fit in mating guide parts formed on both ends of the mating connector body of the mating connector in the longitudinal direction, the reinforcing bracket includes an outer reinforcing bracket fit to the mating guide parts, the outer reinforcing bracket includes a central guide part disposed on an end wall part of the mating guide parts and a pair of contact arms disposed on right and left side wall parts of the mating guide parts, and when the mating connector body of the mating connector is fit in the recess, the contact arms come into contact with a mating reinforcing bracket fit to the mating connector body.

The connector according to the present disclosure can achieve high reliability with a protected state guaranteed for housings with reinforcing brackets being rigid to be free from displacement and misorientation.

BRIEF DESCRIPTION OF THE DRAWINGS

FIGS. 2A-2D are four surface views of the first connector according to the present embodiment, wherein FIG. 2A is an upper view, FIG. 2B is a side view. FIG. 2C is a lower view and FIG. 2D is a front view.

FIGS. 4A and 4B are cross-sectional views of the first connector according to the present embodiment, wherein FIG. 4A is a cross-sectional view along the A-A line in FIG. 2A, and FIG. 4B is a cross-sectional view along the B-B line in FIG. 2A.

DETAILED DESCRIPTION OF THE PREFERRED EMBODIMENTS

Figure 1:
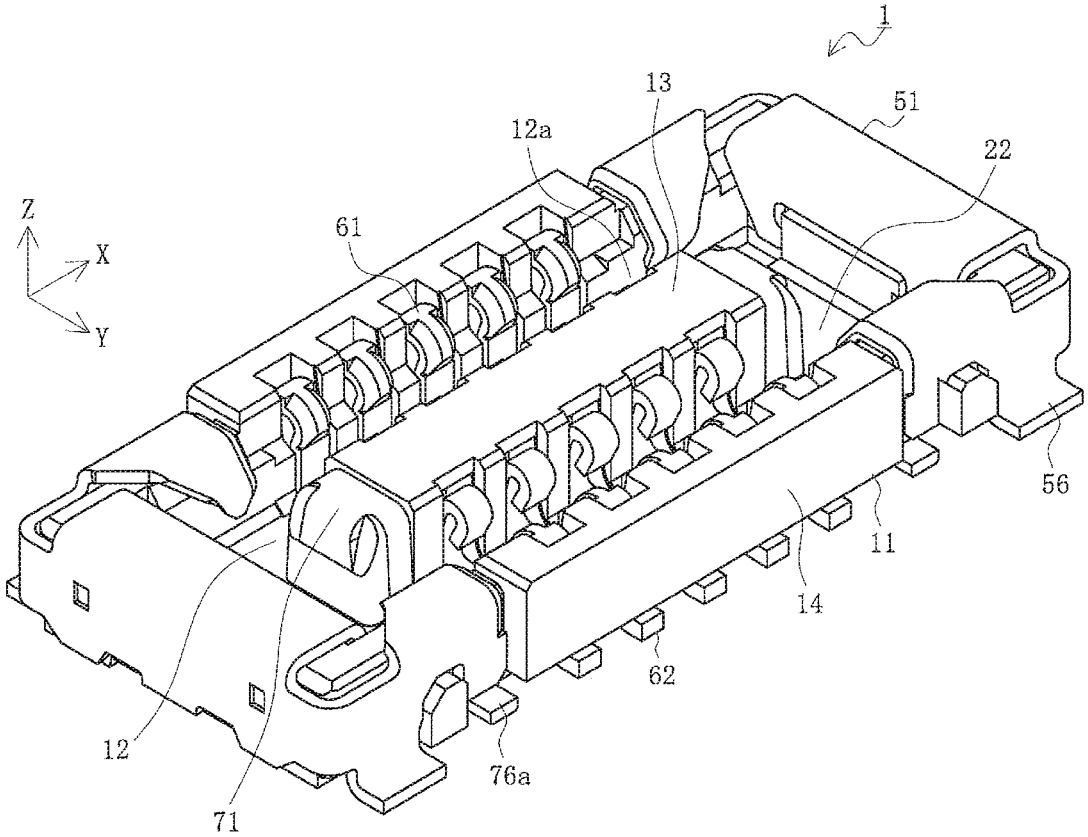
FIG. 1 is a perspective view of a first connector according to the present embodiment.
Figure 2A:
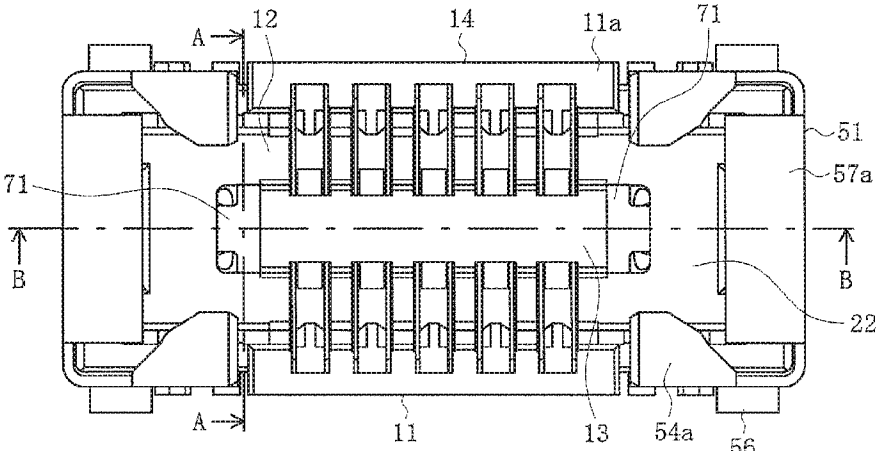
Figure 2B:
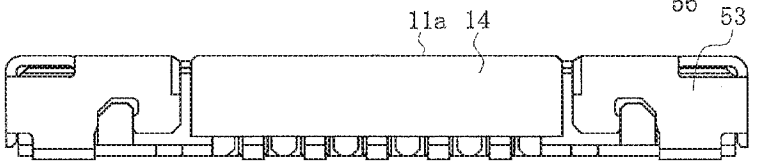
Figure 2C:
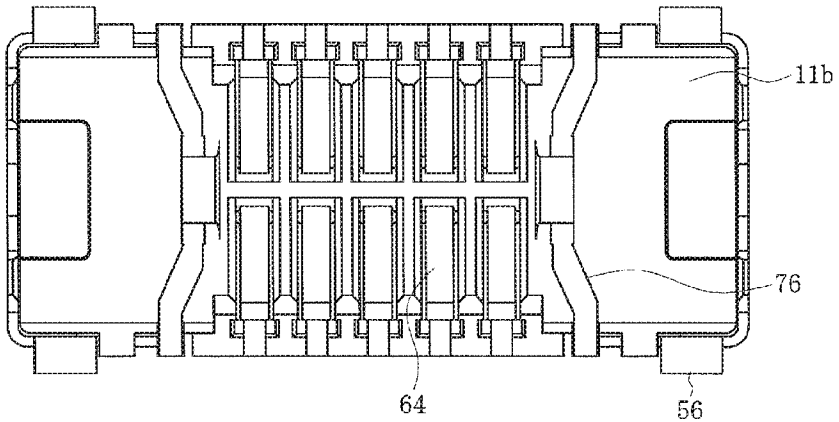
Figure 2D:
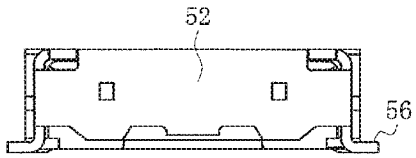
Figure 3:
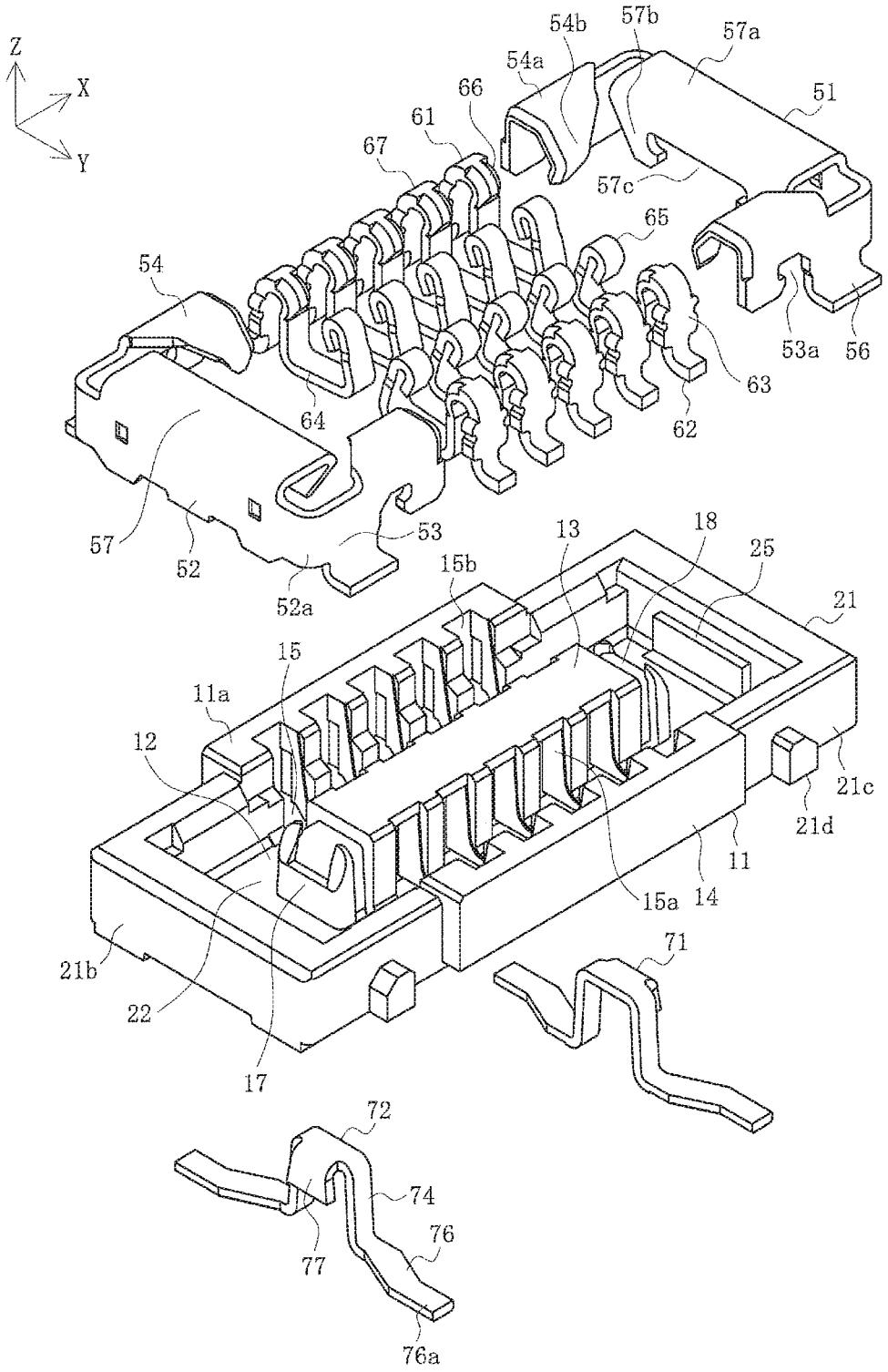
FIG. 3 is an exploded view of the first connector according to the present embodiment.
Figure 4B:
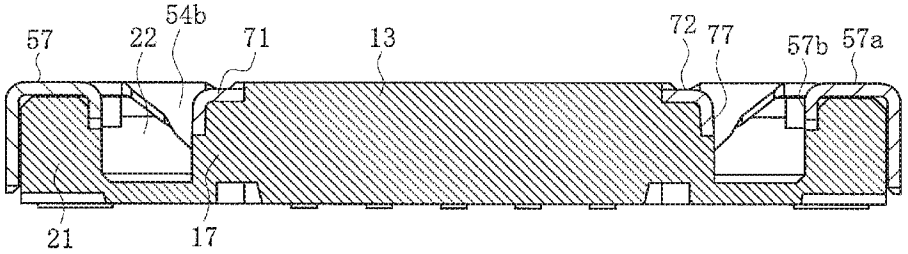
Figure 4A:
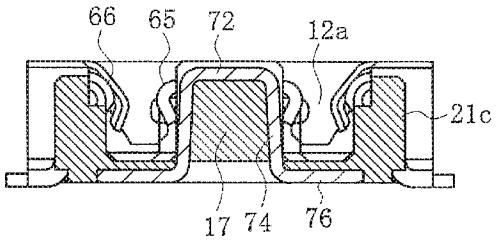

Embodiments will be described in detail below with reference to the drawings,

FIG. 1 is a perspective view of a first connector according to the present embodiment. FIGS. 2A-2D are four surface views of the first connector according to the present embodiment. FIG. 3 is an exploded view of the first connector according to the present embodiment. FIGS. 4A and 4B are cross-sectional views of the first connector according to the present embodiment. FIG. 2A is an upper view, FIG. 2B is a side view, FIG. 2C is a lower view, and FIG. 2D is a front view. FIG. 4A is a cross-sectional view along the A-A line in FIG. 2A, and FIG. 4B is a cross-sectional view along the B-B line in FIG. 2A.

In the figures, 1 is a connector according to the present embodiment and is the first connector serving as one of a pair of board to board connectors. The first connector 1 is a surface mount type connector mounted on the surface of a first substrate not illustrated in the figure that serves as a mounting member, and is mated with a second connector 101 that serves as a mating connector described later. Furthermore, the second connector 101 is the other one of the pair of board to board connectors and is a surface mount type connector mounted on the surface of a second substrate, not illustrated in the figure, serving as a mounting member.

Note that while the first connector 1 and the second connector 101 according to the present embodiment are ideally used for electrically connecting substrates, that is, the first substrate and the second substrate to each other, the connectors can be used to electrically connect other members as well. Examples of the first substrate and second substrate include printed circuit boards, flexible flat cables (FFC), flexible printed circuit boards (FPC), etc. used in electronic equipment, etc. Note that any type of substrate may be used.

Furthermore, expressions for indicating directions such as up, down, left, right, front, and back, used to describe the operations and configurations of the parts of the first connector 1 and the second connector 101 in the present embodiment are not absolute but rather relative directions, and though appropriate when the parts of the first connector 1 and the second connector 101 are in the positions illustrated in the figures, these directions should be interpreted differently when these positions change, to correspond to said change.

Furthermore, the first connector 1 has a first housing 11 serving as a connector body integrally formed of an insulating material such as a synthetic resin. As illustrated in the figure, the first housing 11 is a substantially rectangular parallelepiped member having a substantially rectangular thick plate shape. A substantially rectangular recess 12, in which a second housing 111 described later fits, having the circumference surrounded is formed on the side of the housing in which the second connector 101 fits, that is, on the side of the mating surface 11.*a* (the positive Z-axis direction side). In the recess 12, a first protrusion 13, serving as an insular part to be fit to a groove part 113 described later, is integrally formed with the first housing 11. Side walls 14 are integrally formed with the first housing 11, to be on both sides (positive and negative Y-axis direction sides) of the first protrusion 13, while extending in parallel with the first protrusion 13.

Note that the first protrusion 13 and the side walls 14 protrude upward (positive Z-axis direction) from the bottom surface of the recess 12 and extend in the longitudinal direction of the first housing 11. Thus, groove parts 12*a* are formed on both sides of the first protrusion 13, as elongated recesses extending in the longitudinal direction (X-axis direction) of the first housing 11 and serving as part of the recess 12.

First terminal containing inner cavities 15*a*, each having a groove shape, are formed on both sides of the first protrusion 13. First terminal containing outer cavities 15*b*, each having a groove shape, are formed on inner side surfaces of the side walls 14. The first terminal containing inner cavities 15*a* and the first terminal containing outer cavities 15*b* are integrally connected to each other on the bottom surface of the groove parts 12*a*. Thus, the first terminal containing inner cavities 15*a* and the first terminal containing outer cavities 15*b* may be collectively referred to as first terminal containing cavities 15.

In the present embodiment, the first terminal containing cavities 15 are formed on both sides of the first housing 11 in a width direction (Y-axis direction) to be arranged side by side along the longitudinal direction of the first housing 11. Specifically, a plurality of the cavities are formed on both sides of the first protrusion 13 at a predetermined pitch. A plurality of first terminals 61 that are each a terminal installed in the first housing 11 while being contained in a corresponding one of the first terminal containing cavities 15, are also provided on both sides of the first protrusion 13 at the same pitch.

The first terminals 61 are each an integrated member formed by carrying out processing such as punching and bending on a conductive metal plate. The first terminals 61 each include a held part 63, a tail part 62 connected to a lower end of the held part 63, an upper connecting part 67 connected to an upper end of the held part 63, a second contact part 66 formed around an inner end of the upper connecting part 67, a lower connecting part 64 connected to the second contact part 66, and a first contact part 65 formed around a free end of the lower connecting part 64.

The held part 63 extends in an upper and lower direction (Z-axis direction), that is, in a thickness direction of the first housing 11, and is fit and held in the first terminal containing outer cavity 15*b*. The tail part 62 is connected to the held part 63 in a bent manner, and extends outward in a right and left direction (Y-axis direction), that is, in the width direction of the first housing 11 to be connected to a connection pad, coupled to a conductive trace of the first substrate, by soldering or the like. Typically, the conductive trace is a signal line. The upper connecting part 67 is connected to the held part 63 in a bent manner, and extends inward in the width direction of the first housing 11.

The second contact a 66 is formed on an inner end of the upper connecting part 67 in a downwardly (negative Z-axis direction) bent manner. The second contact part 66 is curved and protrudes inward in the width direction of the first housing 11. The lower connecting part 64 is connected to the lower end of the second contact part 66, and has a U shape in side view. The first contact part 65 that is bent to be in a U shape is formed around a free end of the lower connecting part 64, that is, around the inner upper end. The first contact part 65 is curved and protrudes outward in the width direction of the first housing 11.

The first terminal 61 is fit into the first terminal containing cavity 15 from a mounting surface 11*b* serving as the lower surface (a surface on the negative Z-axis direction side) of the first housing 11. The first terminal 61 is fixed to the first housing 11 with both sides of the held part 63 clamped by the side walls of the first terminal containing outer cavity 15*b*, formed on the inner side surface of the side wall 14, in this state, that is, in a state where the first terminal 61 is mounted on the first housing 11, the first contact part 65 and the second contact part 66 face each other while being positioned on both left and right sides of the groove part 12*a*.

The first terminal 61 is a member integrally formed by carrying out processing on a metal plate, and thus has a certain level of elasticity. The first contact part 65 and the second contact part 66 facing each other can have a distance therebetween is changeable due to elastic deformation, as is apparent from the shapes of these parts. Specifically, when second terminals 161, described later, of the second connector 101 are inserted between the first contact part 65 and the second contact part 66, the distance between the first contact part 65 and the second contact part 66 increases due to elastic deformation.

Moreover, first protruding end parts 21 as mating guide parts are disposed on both ends of the first housing 11 in the longitudinal direction. A mating recess 22 as a portion of the recess 12 is provided to each first protruding end part 21. The mating recesses 22 are substantially rectangular recesses located on both ends of the groove parts 12*a* in the longitudinal direction. Additionally, in the state in which the first connector 1 and the second connector 101 are mated, second protruding end parts 122, described later, of the second connector 101 are inserted into the mating recesses 22.

The first protruding end parts 21 each further include side wall extension parts 21*c* and an end wall part 21*b*. The side wall extension parts 21*c* serve as side wall parts of the first protruding end parts 21 extending in the longitudinal direction of the first housing 11 from both ends of the side walls 14 in the longitudinal direction. The end wall part 21*b* extends in the width direction of the first housing 11, and has both ends connected to the side wall extension parts 21*c*. The end wall part 21*b* and the side wall extension parts 21*c* connected to both ends thereof of each of the first protruding end parts 21 are continuously formed to be a substantially rectangular U-shaped side wall, and define three sides of the mating recess 22 having a substantially rectangular shape. The end wall part 21*b* has an inner surface provided with an inner end protrusion 25 protruding toward the first protrusion 13. The side wall extension parts 21*c* each have an outer surface provided with an outer protrusion 21*d* protruding outward.

An outer reinforcing bracket 51 serving as a reinforcing bracket fit to the first housing 11 is attached to each of the first protruding end parts 21. In the present embodiment, the outer reinforcing bracket 51 is a member integrally formed by carrying out processing such as punching or bending on a metal plate, and includes an outer body part 52 serving as a body part covering the outer side of the end wall part 21*b* of the first housing 11, connecting arms 53 connected to right and left ends of the outer body part 52, contact arms 54 connected to the connecting arms 53, and a central guide part 57 connected to an upper end of the outer body part 52.

The entire outer body part 52 is a strip-shaped member extending in the width direction of the first housing 11. Coach sections 52*a* are connected to the right and left ends of the outer body part 52 in a bent manner relative to the outer body part 52, and have distal ends extending inward in the longitudinal direction of the first housing 11. Thus, the outer body part 52 including the coach sections 52*a* at both ends has a substantially U shape in upper view, that is, plan view.

The connecting arm 53 is connected to the distal end of each of the coach sections 52*a*. The connecting arm 53 is a flat plate shaped part extending in the longitudinal direction of the first housing 11. A lower end of the connecting arm 53 is connected to a connecting leg 56 connected to the first substrate and is provided with a coupling recess 53*a*. The contact arm 54 is connected to an upper end of the distal end of the connecting arm 53.

The connecting leg 56 has a structure similar to the connecting arm 53. Specifically, a portion around the upper end of the connecting leg 56 extends in the upper and lower direction and is bent at an intermediate portion to have a distal end directed outward in the width direction of the first housing 11. Thus, the connecting leg 56 has a substantially L shape as viewed in the X-axis direction. The connecting leg 56 has a lower distal end connected and fixed to the connection pad, coupled to the conductive trace of the first substrate, by soldering or the like. Typically, the conductive trace is a power line. The outer reinforcing bracket 51 is fixed to the first protruding end part 21 of the first housing 11, with the outer protrusion 21*d* fit to the coupling recess 53*a*.

The contact arm 54 has a base end connected to the upper end of the connecting arm 53 and is bent by approximately 180° to have a distal end directed downward. The contact arm 54 includes an upper covering part 54*a* to be placed over the side wall extension parts 21*c* and an inner covering part 54*b* that has a base end connected to the distal end of the upper covering part 54*a*, extending downward, and arranged on the inner side of the side wall extension parts 21*c*. The upper covering part 54*a* is formed to partially cover the upper surface of the side wall extension parts 21*c*, in a state where the outer reinforcing bracket 51 is attached to the first protruding end part 21 as illustrated in FIG. 1. The inner covering part 54*b* bulging inward in the width direction of the first housing 11 is in contact with a later described second reinforcing bracket 151 of the second connector 101, in the state where the first connector 1 and the second connector 101 are mated.

The outer reinforcing bracket 51 is a member integrally formed by carrying out processing on a metal plate, and thus has a certain level of elasticity. The outer reinforcing bracket 51 entirely has a substantially uniform thickness. A distance between the right and the left inner covering parts 54*b* facing each other is changeable through elastic deformation, as is apparent from the shapes of the parts. Specifically, when the second reinforcing bracket 151 of the second connector 101 is inserted between the right and the left inner covering parts 54*b*, the distance between the right and the left inner covering parts 54*b* increases due to elastic deformation.

The central guide part 57 covers at least part of the upper surface of the end wall part 21*b* and the inner surface of the end wall part 21*b* in a state where the outer reinforcing bracket 51 is attached to the first protruding end part 21. The central guide part 57 is a part including: an upper covering part 57*a* that has a base end connected to the upper end of the outer body part 52 and has a curved shape to have a distal end directed diagonally downward, and an inner covering part 57*b* that has a base end connected to the distal end of the upper covering part 57*a* and extends with a distal end directed downward. A protrusion containing opening 57*c* that contains the inner end protrusion 25 is formed at a center portion of the lower end of the inner covering part 57*b*. Thus, the distal end of the inner end protrusion 25 is exposed in the mating recess 22, even in a state where the outer reinforcing bracket 51 is attached to the first protruding end part 21. The outer reinforcing bracket 51 is positioned relative to the first protruding end part 21, with the inner end protrusion 25 fit in the protrusion containing opening 57*c*.

In the present embodiment, an inner reinforcing bracket 71, serving as a reinforcing bracket fit to the first housing 11, is attached to each of insular end parts 17 that are end portions of the first protrusion 13 in the longitudinal direction of the first housing 11. The inner reinforcing brackets 71 are each a member integrally formed by carrying out processing such as punching or bending on a metal plate. The inner reinforcing bracket 71 includes an inner body part 72 serving as a body part extending in the width direction of the first housing 11, side plates 74 having upper ends connected to right and left ends of the inner body part 72 and extending in the upper and lower direction, connecting legs 76 connected to lower ends of the side plates 74 and extending outward in the width direction of the first housing 11, and an end plate 77 having an upper end connected to the center of the inner body part 72 in the right and left direction and extending in the upper and lower direction. The inner body part 72 is disposed on the upper surface (the surface on the positive Z-axis direction side) of the insular end part 17. The end plate 77 is disposed on an end surface (a surface facing the end wall part 21*b*) of the insular end part 17. The side plates 74 are disposed on the right and left side surfaces (surfaces on the positive and negative Y-axis direction sides) of the insular end part 17. The connecting legs 76 each have a substrate connecting part 76*a* at the distal end. The substrate connecting part 76*a* has a lower end connected and fixed to the connection pad of the first substrate by soldering or the like.

In FIG. 3, the inner reinforcing bracket 71 is separated from the first housing 11, for the sake of description. Note that, the inner reinforcing bracket 71 is preferably integrated with first housing 11 by a molding method referred to as overmolding or insert molding. Specifically, the first housing 11 is preferably molded by filling the cavity of a mold, in which the inner reinforcing bracket 71 has been set beforehand, with an insulating material. Thus, the inner reinforcing bracket 71 is integrally attached to the first housing 11, with the surfaces of the inner body part 72, the side plates 74, and the end plate 77 exposed on the side of the mating surface 11*a*, the lower surface of the connecting legs 76 exposed on the side of the mounting surface 11*b*, and other parts embedded in the first housing 11. The insular end part 17 has the upper surface, at least part of the upper half of the end surface, and at least part of both right and left side surfaces covered by the inner reinforcing bracket 71.

Next, the configuration of second connector 101 will be described.

Figure 5:
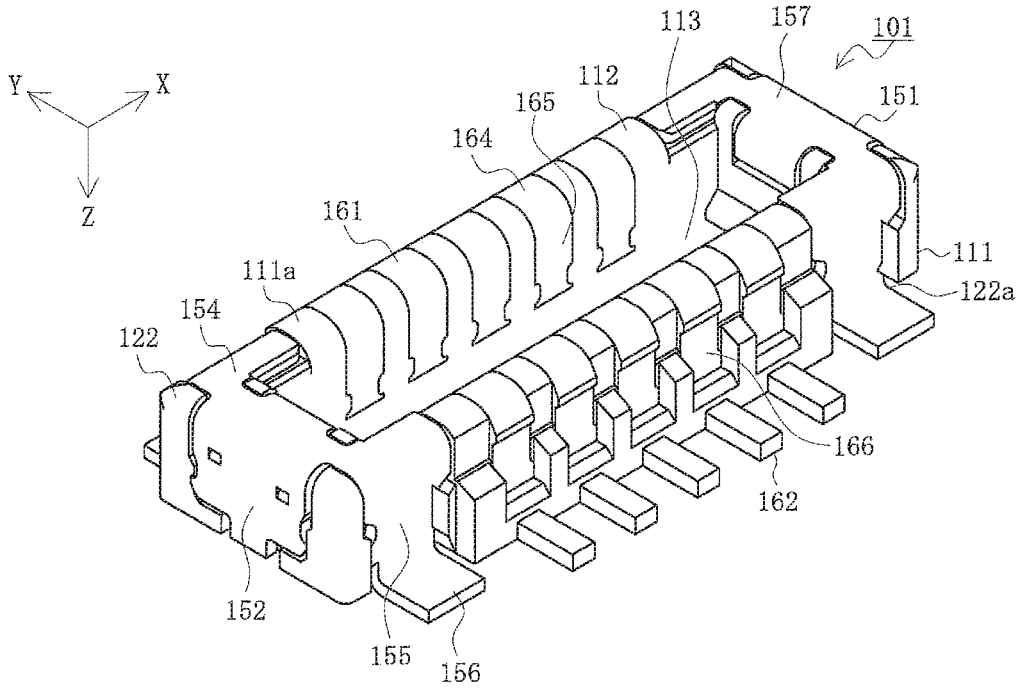
FIG. 5 is a perspective view of a second connector according to the present embodiment.

FIG. 5 is a perspective view of the second connector according to the present embodiment.

The second connector 101 as a mating connector according to the present embodiment has the second housing 111 serving as a mating connector body integrally formed of an insulating material such as a synthetic resin. As illustrated in the figure, the second housing 111 is a substantially rectangular parallelepiped member having a substantially rectangular thick plate shape. The elongated groove part 113, extending in the longitudinal direction (X-axis direction) of the second housing 111, and second protrusions 112 are integrally formed on the side in which the second housing 111 fits in the first connector 1, that is, on a mating surface 111*a* side (negative Z-axis direction side). The second protrusions 112 are thin elongate protrusions defining the outer sides of the groove part 113 while extending in the longitudinal direction of the second housing 111. The second protrusions 112 are formed along both sides (positive and negative Y-axis direction sides) of the groove part 113 and along both sides of the second housing 111.

Additionally, the second terminals 161 as mating terminals are each provided to a corresponding one of the second protrusions 112. The pitch and the number of the second terminals 161 are the same as those of the first terminals 61. The groove part 113 has a side mounted on the second substrate, that is, amounting surface side (positive Z-axis direction side) closed by a bottom plate.

The second terminals 161 are each a member integrally formed by carrying out processing such as punching or bending on a conductive metal plate. The second terminal 161 includes a body part (not illustrated), a tail part 162 connected to the lower end of the body part, a first contact part 165 connected to the upper end of the body part, a connecting part 164 connected to the upper end of the first contact part 165, and a second contact part 166 connected to an outer end of the connecting part 164.

The body part is an unillustrated part held while having its circumference surrounded by the second housing 111. The tail part 162 is connected to the lower end of the body part extending in the right and left direction, that is, in the width direction of the second housing 111, extends outward from the second housing 111, and is connected to the connection pad, coupled to a conductive trace of the second substrate, by soldering or the like. Typically, the conductive trace is a signal line.

The second terminal 161 is integrated with the second housing 111 by a molding method referred to as overmolding or insert molding. Specifically, the second housing 111 is molded by filling the cavity of a mold, in which the second terminal 161 has been set beforehand, with an insulating material. Thus, the second terminal 161 is integrally attached to the second housing 111 with the body part embedded in the second housing 111 and with the surfaces of the first contact part 165, the connecting part 164, and the second contact part 166 exposed on the side surfaces of the second protrusion 112 and the mating surface 111*a*.

Moreover, the second protruding end part 122 serving as a mating guide part is disposed on each of both ends of the second housing 111 in the longitudinal direction. The second protruding end part 122 is a thick member that extends in the width direction (Y-axis direction) of the second housing 111, has both ends connected to both ends of a corresponding one of the second protrusions 112 in the longitudinal direction, and has a substantially rectangular upper surface. In the state in which the first connector 1 and the second connector 101 are mated, the second protruding end part 122 functions as an insertion protrusion inserted into the mating recess 22 of the first protruding end part 21 included in the first connector 1. The second protruding end part 122 includes a reinforcing bracket containing recess 122*a*. The second reinforcing bracket 151 serving as a mating reinforcing bracket is contained in the reinforcing bracket containing recess 122*a* and is attached to the second protruding end part 122.

The second reinforcing bracket 151 in the present embodiment is a member integrally formed by carrying out processing such as punching or bending on a metal plate. The second reinforcing bracket 151 includes a second body part 152 extending in the width direction of the second housing 111, a center covering part 157 connected to the upper end of the second body part 152, side covering parts 154 connected to right and left ends of the center covering part 157, contact side plate parts 155 connected to one of side edges of the side covering parts 154, and substrate connecting parts 156 connected to the lower end of the contact side plate parts 155.

The center covering part 157 is designed to have a shape and a size sufficient for covering most of the upper surface of the second protruding end part 122, in the state where the second reinforcing bracket 151 is attached to the second protruding end part 122 as illustrated in FIG. 5. The side covering parts 154 extend from the right and left ends of the center covering part 157 in the longitudinal direction of the second housing 111, and cover the upper surfaces around both ends of the second protrusion 112 in the longitudinal direction. The contact side plate parts 155 cover outer side surfaces around both ends of the second protrusion 112 in the longitudinal direction. The side covering parts 154 and the contact side plate parts 155 connected to the side edges thereof are continuously provided over the upper surface of the second protrusion 112 and the outer side surfaces of the second protrusion 112, around both ends of the second protrusion 112 in the longitudinal direction. The substrate connecting part 156 extends outward from the second housing 111 and is connected and fixed to the connection pad, coupled to the conductive trace of the second substrate, by soldering or the like. Typically, the conductive trace is a power line.

Next, an operation for mating the first connector 1 and the second connector 101 having the above-mentioned configuration will be described.

Figure 6:
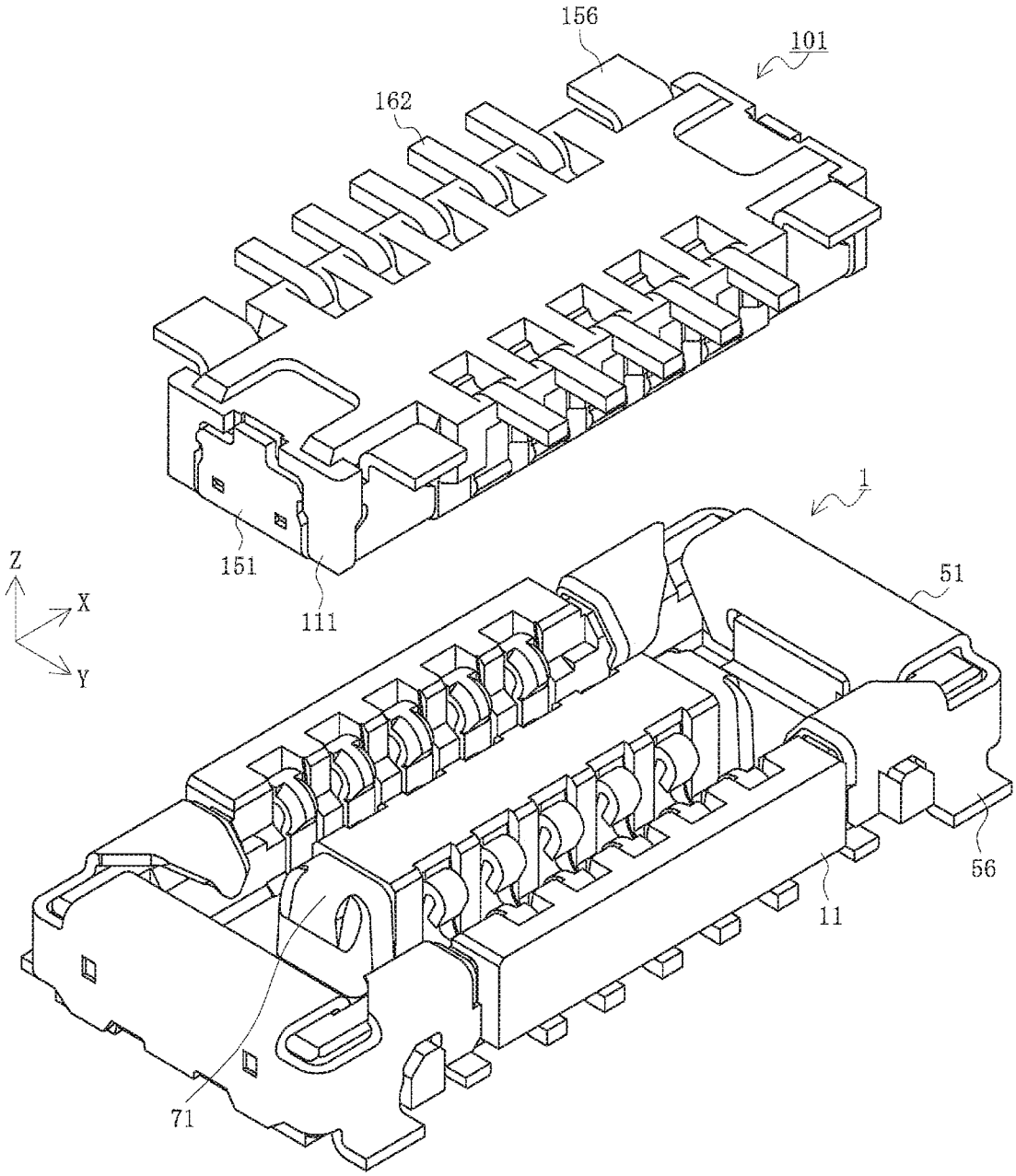
FIG. 6 is a perspective view illustrating positional relationship between the first connector and the second connector according to the present embodiment in a connector mating step.
Figure 7:
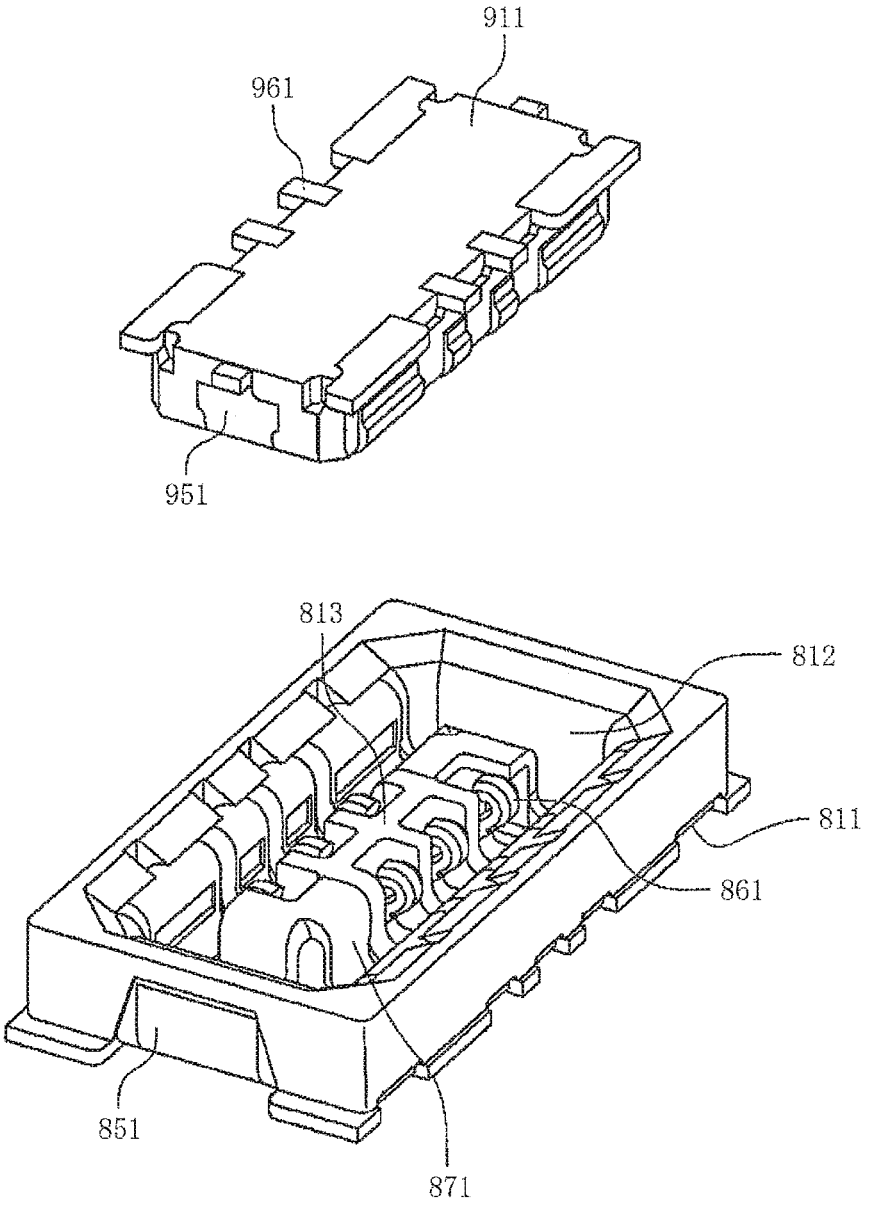
FIG. 7 Prior Art
FIG. 7 is a perspective view illustrating a conventional connector.

FIG. 6 is a perspective view illustrating positional relationship between the first connector and the second connector according to the present embodiment in a connector mating step.

Here, the first connector 1 is mounted on the surface of the first substrate with the tail part 62 of the first terminal 61 connected to the connection pad, coupled to the conductive trace of the first substrate (not illustrated), by soldering or the like, with the connecting leg 56 of the outer reinforcing bracket 51 connected to the connection pad coupled to the conductive trace of the first substrate by soldering or the like, and with the substrate connecting part 76*a* of the inner reinforcing bracket 71 connected to the connection pad of the first substrate by soldering or the like. The conductive trace coupled to the connection pad to which the tail part 62 of the first terminal 61 is connected is a signal line. The conductive trace coupled to the connection pad to which the connecting leg 56 of the outer reinforcing bracket 51 is connected is a power line.

Similarly, the second connector 101 is mounted on the surface of the second substrate with the tail part 162 of the second terminal 161 connected to the connection pad, coupled to the conductive trace of the second substrate (not illustrated), by soldering or the like, and with the substrate connecting part 156 of the second reinforcing bracket 151 connected to the connection pad, coupled to the conductive trace of the second substrate, by soldering or the like. The conductive trace coupled to the connection pad to which the tail part 162 of the second terminal 161 is connected is a signal line. The conductive trace coupled to the connection pad to which the substrate connecting part 156 of the second reinforcing bracket 151 is connected is a power line.

First of all, as illustrated in FIG. 6, the operator achieves a state where the mating surface 11*a* of the first housing 11 of the first connector 1 faces the mating surface 111*a* of the second housing 111 of the second connector 101. Positioning of the first connector 1 and the second connector 101 is completed when the position of the second protrusion 112 of the second connector 101 matches the position of the corresponding groove part 12*a* of the first connector 1 and the position of the second protruding end part 122 of the second connector 101 matches the position of the corresponding mating recess 22 of the first connector 1.

In this state, when the first connector 1 and/or the second connector 101 is moved toward the counterpart(s), that is, moved in a mating direction (Z-axis direction), the second protrusion 112 and the second protruding end part 122 of the second connector 101 are inserted in the groove part 12*a* and the mating recess 22 of the first connector 1. The first terminal 61 and the second terminal 161 achieve a conductive state upon completion of the mating between the first connector 1 and the second connector 101.

Specifically, the second terminal 161 of the second connector 101 is inserted between the first contact part 65 and the second contact part 66 of each of the first terminals 61. As a result, the first contact part 65 of the first terminal 61 comes into contact with the first contact part 165 of the second terminal 161, and the second contact part 66 of the first terminal 61 comes into contact with the second contact part 166 of the second terminal 161. As a result, the conductive trace coupled to the connection pad on the first substrate to which the tail part 62 of the first terminal 61 is connected becomes conductive with the conductive trace coupled to the connection pad on the second substrate to which tail part 162 of the second terminal 161 is connected.

Incidentally, because the first connector 1 and the second connector 101 are respectively mounted on the first substrate and second substrate which have wide areas, the mating surface of the first connector 1 and the mating surface of the second connector 101 are invisible to the operator. Thus, the operator can only rely on a tactile impression to perform the mating. The tactile impression is insufficient for precise positioning, and thus might result in a mismatch of the positions of the first connector 1 and the second connector 101. For example, the second connector 101 might be misaligned relative to the first connector 1, and the mating surface of the second connector 101 might be inclined relative to the mating surface of the first connector 1.

In this state, when the operator moves the first connector 1 and/or the second connector 101 in the mating direction, any one of the second protruding end parts 122 of the second connector 101 abuts any one of the insular end parts 17 of the first protrusion 13 of the first connector 1. As a result, the insular end part 17 receives great pressing force from the second protruding end part 122 in the mating direction or in a direction crossing the mating direction. The insular end parts 17 are end portions of the relatively narrow first protrusion 13 and each have three side surfaces in the X-Y directions surrounded by the recess 12. Thus, the pressing force might be applied not only to the upper surface facing the positive Z-axis direction, but also to the three side surfaces, that is, a side surface facing the end wall part 21*b* of the first protruding end part 21 and two side surfaces facing the side wall extension parts 21*c*.

In view of this, in the present embodiment, the inner reinforcing bracket 71 is attached to the insular end part 17, so that the upper surface and the three side surfaces of the insular end part 17 are mostly covered by the inner body part 72, the side plates 74, and the end plate 77 of the inner reinforcing bracket 71. Thus, large pressing force applied from the second protruding end part 122 is transmitted to the first substrate through the connecting legs 76 from the side plates 74 of the inner reinforcing bracket 71, and thus is almost not transmitted to the upper surface and the three side surfaces of the insular end part 17 at all. Thus, the upper surface and the three side surfaces of the insular end part 17 are not broken or damaged.

The insular end parts 17 are end portions of the relatively narrow first protrusion 13, and thus might fall down in the Y-axis direction upon receiving pressing force including a component in the Y-axis direction, in particular. In view of this, in the present embodiment, the inner reinforcing bracket 71 is attached to the insular end part 17 with the pair of connecting legs 76, connected via the side plates 74 connected to both ends of the inner body part 72 in the Y-axis direction, extending toward both sides in the Y-axis direction, and with the substrate connecting parts 76*a* at the distal ends of the connecting legs 76 connected and fixed to the connection pad of the first substrate by soldering or the like. This ensures no risk of the insular end part 17 falling down in the Y-axis direction.

When pressing force including a component toward the end wall part 21*b* of the first protruding end part 21 is applied, the inner reinforcing bracket 71 might incline toward the end wall part 21*b*, and the end plate 77 might be separated from the side surface of the insular end part 17 facing the end wall part 21*b* in particular. In view of this, in the present embodiment, the inner reinforcing bracket 71 attached to the insular end part 17 include the pair of connecting legs 76, connected via the side plates 74 connected to both ends of the inner body part 72 in the Y-axis direction, extending toward both sides in the Y-axis direction and the substrate connecting part 76*a* at the distal ends of the connecting legs 76 are connected and fixed to the connection pad of the first substrate by soldering or the like. This ensures no risk of the end plate 77 with the insular end part 17 inclining.

Furthermore, the outer reinforcing bracket 51 is attached to the first protruding end part 21, and the upper surfaces (surfaces on the positive Z-axis direction side) of the end wall part 21*b* and the side wall extension parts 21*c* connected to both ends of the end wall part 21*b* are mostly covered by the central guide part 57 and the contact arms 54. Thus, even when large pressing force is applied from the second protruding end part 122, the pressing force is transmitted from the outer body part 52 and the contact arms 54 of the outer reinforcing bracket 51 to the first substrate through the connecting leg 56, and thus is almost not transmitted to the end wall part 21*b* and the side wall extension parts 21*c* at all. Thus, the end wall part 21*b* and the side wall extension parts 21*c* are not broken or damaged.

As described above, in the present embodiment, the first connector 1 includes the first housing 11, the first terminal 61 installed in the first housing 11, and the reinforcing bracket fit to the first housing 11. The first housing 11 includes the recess 12 in which the second housing 111 of the second connector 101 fits, and the first protrusion 13 that is in the recess 12 and fits in the groove part 113 of the second housing 111. The reinforcing bracket includes the inner reinforcing brackets 71 fit to the insular end parts 17 that are end portions of the first protrusion 13 in the longitudinal direction. The inner reinforcing brackets 7 leach include the inner body part 72 that is disposed on the upper surface of the insular end part 17, the end plate 77 that is connected to the inner body part 72 and is disposed on the end surface of the insular end part 17, the pair of side plates 74 that are connected to the right and left ends of the inner body part 72 and are disposed on the right and left side surfaces of the insular end part 17, and the pair of connecting legs 76 that are each connected to a lower end of a corresponding one of the side plates 74 and extend outward in the width direction of the first housing 11.

With this configuration, the insular end parts 17 serving as the end portion of the first protrusion 13 of the first housing 11 in the longitudinal direction can be appropriately protected by the inner reinforcing brackets 71 so as not to be damaged or broken during the mating operation. The inner reinforcing brackets 71 are rigid and are free from displacement and misorientation, and thus guarantee protection for the insular end parts 17. This ensures the protected state of the first housing 11 to be maintained, whereby reliability can be improved.

The connecting legs 76 each have the distal end connected to the surface of the first substrate on which the first connector 1 is mounted. This ensures prevention of displacement and misorientation of the inner reinforcing bracket 71.

The connecting legs 76 each have the lower surface at least partially exposed on the mounting surface 11*b* of the first housing 11. The inner reinforcing brackets 71 are at least partially embedded in the first housing 11, and are integrated with the first housing 11. This more reliably ensures prevention of the displacement or misorientation of the inner reinforcing brackets 71.

The first housing 11 further includes the first protruding end parts 21 that are formed on both ends of the first housing 11 in the longitudinal direction and are fit in the second protruding end parts 122 formed on both ends of the second housing 111 of the second connector 101 in the longitudinal direction. The reinforcing bracket includes the outer reinforcing brackets 51 fit to the first protruding end parts 21. The outer reinforcing brackets 51 each include the central guide part 57 disposed on the end wall part 21*b* of a corresponding one of the first protruding end parts 21 and the pair of contact arms 54 disposed on the right and left side wall extension parts 21*c* of the first protruding end part 21. When the second housing 111 of the second connector 101 is fit in the recess 12, the contact arms 54 come into contact with the second reinforcing brackets 151 fit to the second housing 111. With this configuration, the first protruding end parts 21 of the first housing 11 are appropriately protected by the outer reinforcing brackets 51 so as not to be damaged or broken during the mating operation. Furthermore, this configuration ensures the state where the outer reinforcing bracket 51 and the second reinforcing bracket 151 are engaged to be maintained, and thus ensures the state where the outer reinforcing bracket 51 is conductive with the second reinforcing bracket 151 to be maintained, whereby the reliability can be improved.

Note that the disclosure of the present specification describes characteristics related to preferred and exemplary embodiments. Various other embodiments, modifications and variations within the scope and spirit of the claims appended hereto could naturally be conceived by persons skilled in the art by summarizing the disclosures of the present specification.

The present disclosure can be applied to connectors.

The invention claimed is:

1. A connector comprising:

a housing having a mating surface and a mounting surface, the mating surface being configured to be mated to a mating connector, the mounting surface being configured to be mounted to a substrate, the housing having a recess defined therein at the mating surface, the recess defining a bottom wall, first and second side walls and first and second end walls, the housing having a protrusion which protrudes upwardly from the bottom wall of the recess, the protrusion being separated from each of the first and second side walls and each of the first and second end walls, the protrusion having first and second end portions, each of the first and second end portions having an upper surface, an end surface and first and second side surfaces;

a plurality of terminals mounted in the housing; and first and second inner reinforcing brackets, each of the first and second inner reinforcing brackets having a body part, an end plate, first and second side plates, and first and second connecting legs, the end plate being operatively associated with an outer end of the body part, an upper end of the first side plate being operatively associated with a first side end of the body part, an upper end of the second side plate being operatively associated with a second side end of the body part, the first connecting leg being operatively associated with a lower end of the first side plate and extending to a free end thereof, the second connecting leg being operatively associated with a lower end of the second side plate and extending to a free end thereof, wherein the free ends of the first and second connecting legs of the first reinforcing bracket are positioned more proximate to the first end wall than are the first and second side plates of the first reinforcing bracket, and wherein the free ends of the first and second connecting legs of the second reinforcing bracket are positioned more proximate to the second end wall than are the first and second side plates of the second reinforcing bracket.

2. The connector as defined in claim 1, wherein the first inner reinforcing bracket is integrated with the first end portion of the housing whereby the body part of the first inner reinforcing bracket is disposed on the upper surface of the first end portion, the end plate of the first inner reinforcing bracket is disposed on the end surface of the first end portion, the first side plate of the first inner reinforcing bracket is disposed on the first side surface of the first end portion, the second side plate of the first inner reinforcing bracket is disposed on the second side surface of the first end portion, whereby surfaces of the body part, the end plate and the first and second side plates of the first inner reinforcing bracket are only exposed on a side of the mating surface of the housing, whereby the first and second connecting legs of the first inner reinforcing bracket are disposed on the bottom wall of the housing, and whereby surfaces of the first and second connecting legs of the first inner reinforcing bracket are only exposed on a side of the mounting surface of the housing and are configured to be mounted to the substrate, and wherein the second inner reinforcing bracket is integrated with the second end portion of the housing whereby the body part of the second inner reinforcing bracket is disposed on the upper surface of the second end portion, the end plate of the second inner reinforcing bracket is disposed on the end surface of the second end portion, the first side plate of the second inner reinforcing bracket is disposed on the first side surface of the second end portion, the second side plate of the second inner reinforcing bracket is disposed on the second side surface of the second end portion, whereby surfaces of the body part, the end plate and the first and second side plates of the second inner reinforcing bracket are only exposed on the side of the mating surface of the housing, whereby the first and second connecting legs of the second inner reinforcing bracket are disposed on the bottom wall of the housing, and whereby surfaces of the first and second connecting legs of the second inner reinforcing bracket are only exposed on the side of the mounting surface of the housing and are configured to be mounted to the substrate.

3. The connector as defined in claim 1, wherein the first inner reinforcing bracket covers the upper surface of the first end portion, at least part of an upper half of the end surface of the first end portion, at least part of the first side surface of the first end portion, and at least part of the second side surface of the first end portion, and wherein the second inner reinforcing bracket covers the upper surface of the second end portion, at least part of an upper half of the end surface of the second end portion, at least part of the first side surface of the second end portion, and at least part of the second side surface of the second end portion.

4. The connector as defined in claim 1, wherein each of the first and second connecting legs of each of the first and second inner reinforcing brackets has a substrate connecting part provided proximate to the free ends thereof, the substrate connecting parts having a lower end that is configured to be connected and fixed to the substrate.

5. The connector as defined in claim 4, wherein the substrate connecting parts of the first and second connecting legs of the first reinforcing bracket are positioned more proximate to the first end wall than are the first and second side plates of the first reinforcing bracket, and wherein the substrate connecting parts of the first and second connecting legs of the second reinforcing bracket are positioned more proximate to the second end wall than are the first and second side plates of the second reinforcing bracket.

* * * * *